US006212716B1

(12) United States Patent
Logan, Jr. et al.

(10) Patent No.: US 6,212,716 B1
(45) Date of Patent: Apr. 10, 2001

(54) INFLATABLE PILLOW

(75) Inventors: Emanuel L. Logan, Jr., Columbia; John R. Moses, Annapolis, both of MD (US)

(73) Assignee: Logan-Moses Enterprises An Unicorporated Business Organization

( * ) Notice: Subject to any disclaimer, the term of this patent is extended or adjusted under 35 U.S.C. 154(b) by 0 days.

(21) Appl. No.: 09/188,710

(22) Filed: Nov. 10, 1998

Related U.S. Application Data

(60) Provisional application No. 60/065,413, filed on Nov. 12, 1997.

(51) Int. Cl.[7] ..... A47C 20/02

(52) U.S. Cl. ..... 5/644; 5/636; 5/655.3; 383/35; 383/63; 383/3

(58) Field of Search ..... 5/636, 644, 652.2, 5/654, 655.3, 709, 420; 383/3, 33, 34, 63, 907, 104, 119, 105, 35

(56) References Cited

U.S. PATENT DOCUMENTS 3,724,461 * 4/1973 Eisenberg ..... 383/35 X
4,262,581 * 4/1981 Ferrell ..... 383/63 X
4,362,198 * 12/1982 Kamp ..... 383/63
4,498,591 * 2/1985 Smith, II ..... 383/35 X
4,969,751 * 11/1990 Diamond et al. ..... 383/33 X
5,000,500 * 3/1991 Almog ..... 383/35 X
5,174,658 * 12/1992 Cook et al. ..... 383/63 X
5,184,896 * 2/1993 Hammond et al. ..... 383/34 X
5,618,111 * 4/1997 Porchia et al. ..... 383/63

FOREIGN PATENT DOCUMENTS

2205236 * 12/1988 (GB) ..... 5/655.3

* cited by examiner

*Primary Examiner*—Terry Lee Melius
*Assistant Examiner*—James M Hewitt
(74) *Attorney, Agent, or Firm*—Millen, White, Zelano & Branigan, P.C.

(57) ABSTRACT

A pillow is formed from a ZIPLOC® bag by either placing a collapsible regulator within the bag which holds the walls of the bag apart when the mouth of the bag is opened or by prestressing the bag in a way that bows the walls of the bag apart, whereby when the mouth of the bag is open, air introduced into the bag is trapped therein upon again closing the bag.

6 Claims, 4 Drawing Sheets

INFLATABLE PILLOW

This application claims benefit of Provisional Application No. 60/065,413 filed Nov. 12, 1997.

FIELD OF THE INVENTION

The present invention relates to an inflatable pillow. More particularly, the present invention relates to an inflatable pillow which has a novel means of inflation.

BACKGROUND OF THE INVENTION

Airlines, hospital emergency rooms, campers, travelers and many other entities use pillows. If a pillow is an inflatable pillow, the normal way to inflate the pillow is to blow into a closed sac through a tube and then, in some way, constrict or plug the tube in order to keep air within the pillow. This is not a convenient or necessarily rapid way to inflate a pillow.

SUMMARY OF THE INVENTION

The present invention is directed to an inflatable pillow which utilizes a ZIPLOC® bag having a regulator therein, which regulator is normally flat. When the mouth of the bag is opened and the pillow shaken, the regulator spreads the bag so as to increase its interior volume. Thereafter, when the mouth of the bag is zipped shut a quantity of air is trapped in the bag. When the bag is tilted, the regulator falls flat and a quantity of air remains trapped in the bag so as to provide a pneumatic support.

In one aspect of the invention, the regulator is a folded relatively rigid structure disposed within the bag which pushes the sides of the bag apart by bearing on internal surfaces of the bag. In another embodiment of the invention, the bag is pre-stressed so that it opens when a force is taken off the bag by, for example, but not limited to, removing the bag from an envelope or enclosing sleeve, or by simply unfolding the bag or opening the bag.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
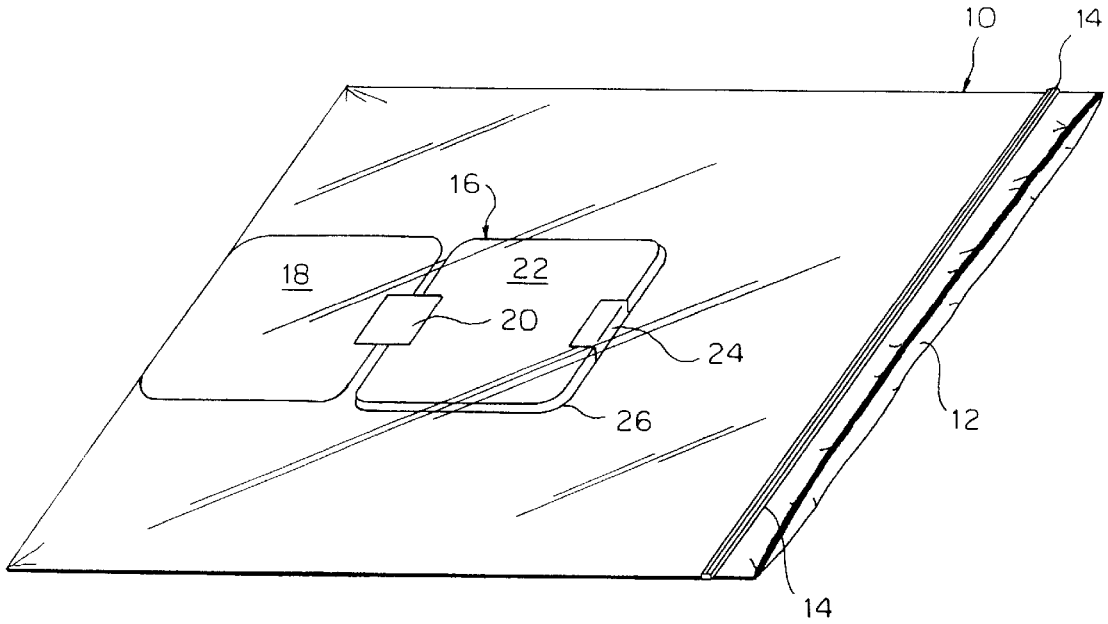
FIG. 1 is a perspective view showing an uninflated bag with a regulator device inside.

Referring now to FIG. 1, there is shown a bag 10, such as a ZIPLOC® bag, having a mouth 12 which is closed by a seam 14 wherein the seam is a ZIPLOC® type of seam having at least one rib which is received in at least one groove. Received in the bag is a regulator 16 which, in FIG. 1, lies flat within the bag.

Figure 3:
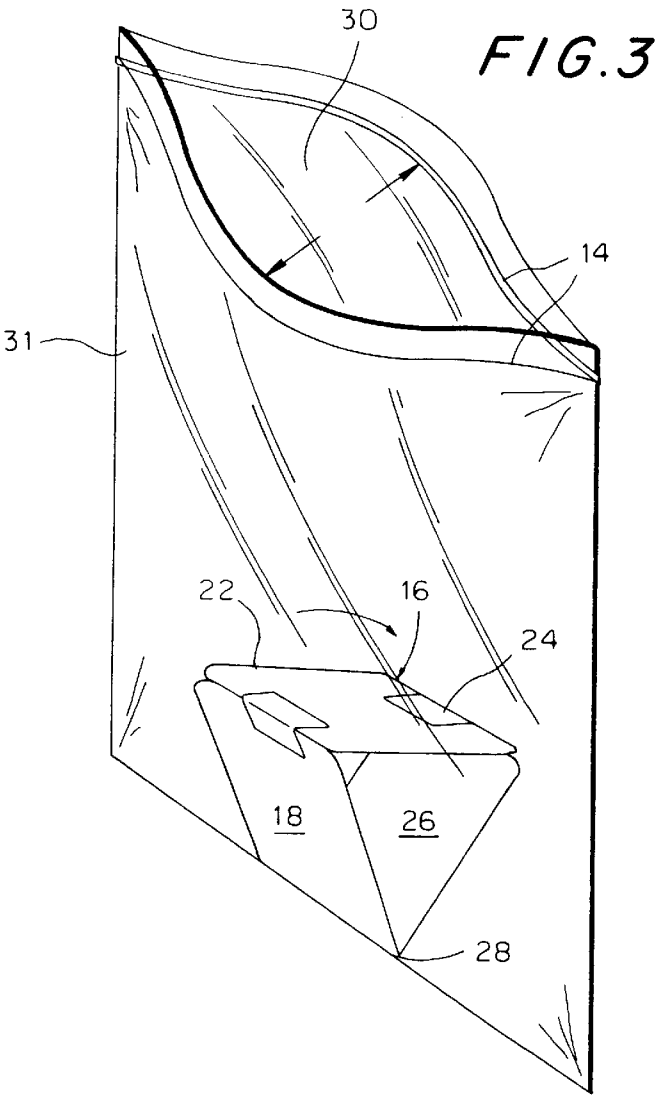
FIG. 3 is a perspective view showing a regulator expanding the bag as the mouth of the bag is opened.
Figure 2:
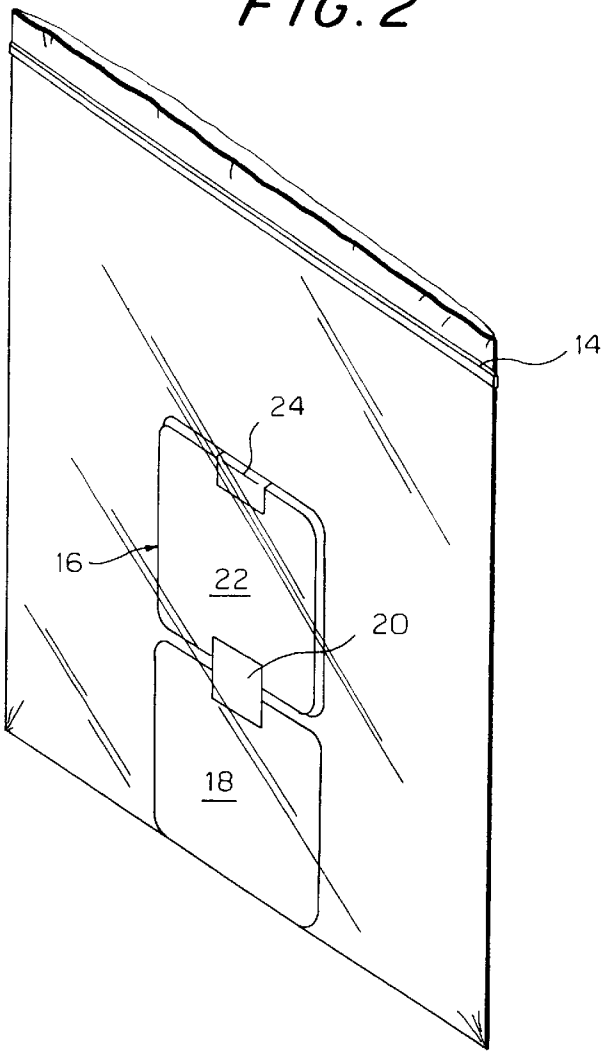
FIG. 2 is a perspective view showing the bag of FIG. 1 oriented vertically in preparation to active a regulator.
Figure 4:
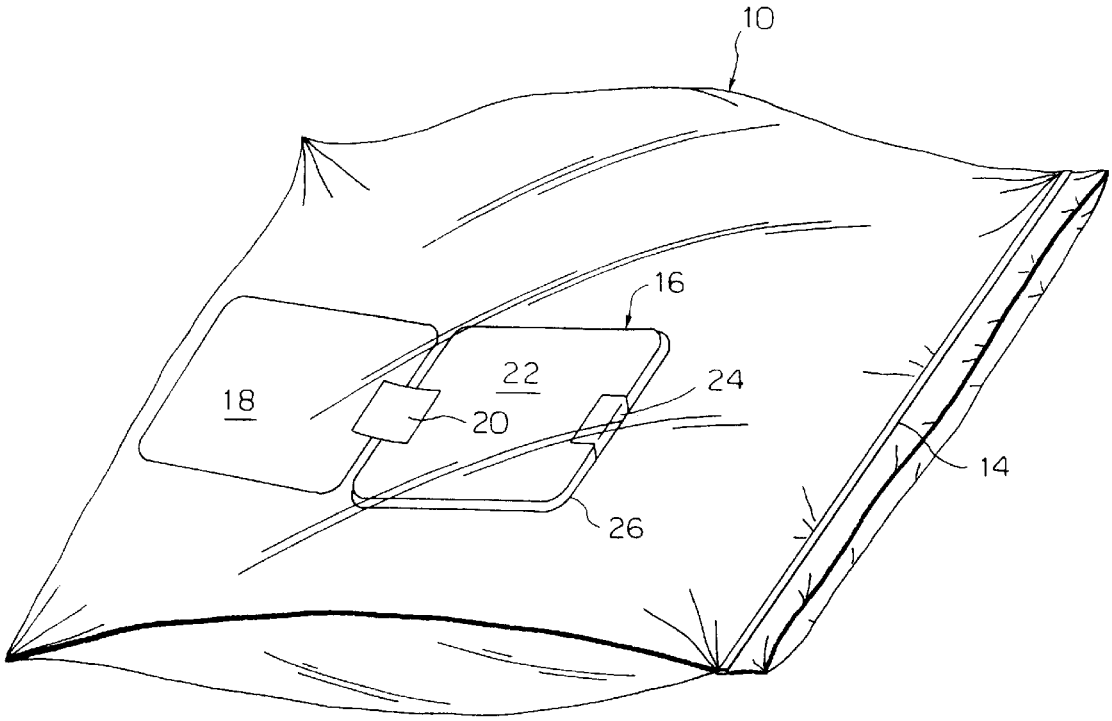
FIG. 4 is a perspective view showing the regulator collapsed flat when the bag is laid flat.

Referring now to FIGS. 2 and 3, the regulator 16 is comprised of an attachment tab 18, which is hinged by a hinge 20 to a regulator panel 22 that is hinged by a hinge 24 to a support arm 26. When the mouth 12 of the bag is open by unzipping the ZIPLOC® seam 14 while the bag 10 is held in a vertical orientation as shown in FIGS. 2 and 3, the regulator 16 expands into a triangular shape because the attachment tab 18 is adhered to the inside surface of the bag 10 and the regulator panel 22 falls until the bottom edge 28 of the support arm slides down an opposite wall 30 of the bag 10 and abuts the bottom of the attachment tab 18. The bag 10 is therefore held open because the panel 22 forms a strut that holds the two side panels 30 and 31 apart so that regular atmospheric air under atmospheric pressure fills the bag. The ZIPLOC® seam 14 is then closed trapping air inside. When the bag is laid flat, the regulator 16 collapses and an inflated pillow results. This is the preferred embodiment of the invention.

Figure 5:
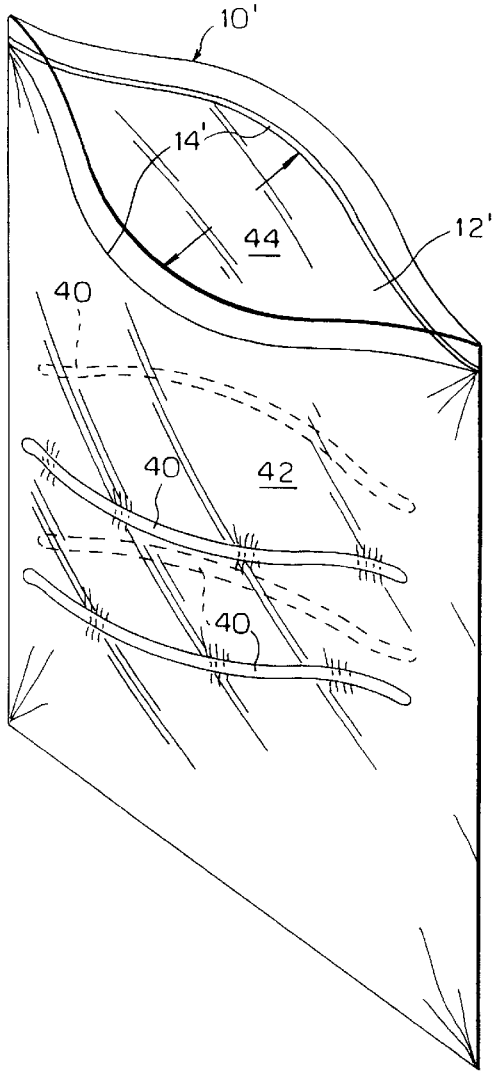
FIG. 5 is a perspective view of a prestressed bag with the mouth open.
Figure 6:
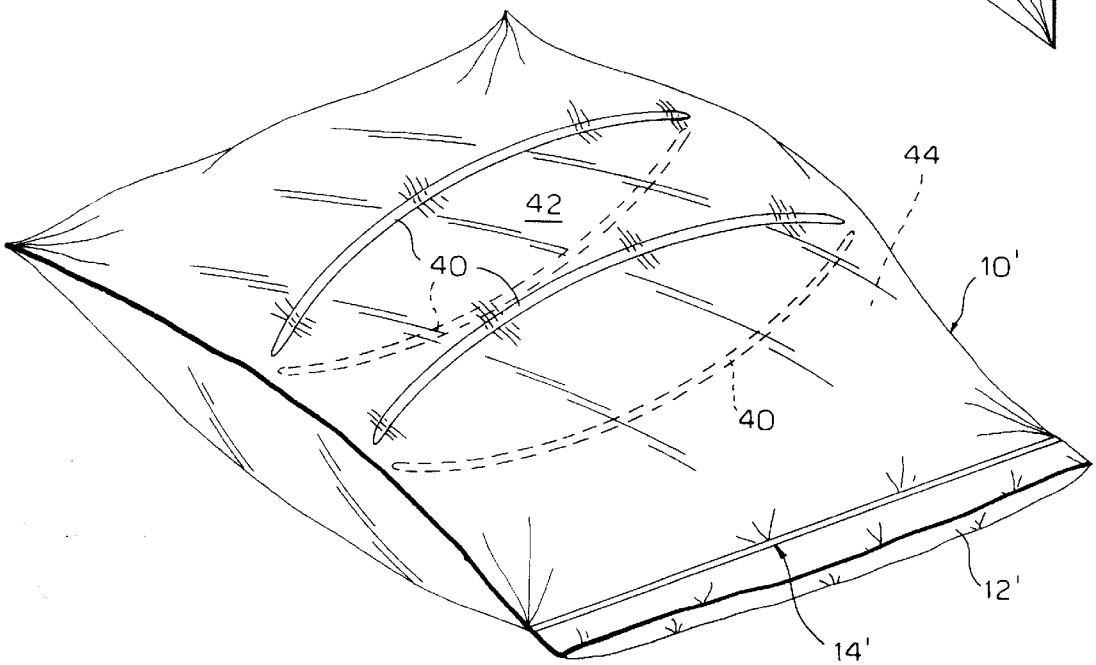
FIG. 6 is a perspective view of a prestressed bag with the mouth closed to trap air in the bag so as to form a pillow.

In another embodiment of the invention, the bag 10' is prestressed so that when it is unfolded or otherwise relieved of forces that tend to keep the bag flat, the bag will expand when the mouth 12' is open. When the mouth is thereafter closed and sealed, air is trapped within the bag so that an inflatable pillow results. This embodiment is shown in FIGS. 5 and 6 which show stress lines or areas 40 embossed or otherwise formed in the two side panels 42 and 44 of the bag, which stress lines or areas bow the bag outwardly when pressure tending to keep the bag flat is released therefrom. While the lines or areas shown extend in the direction of the extent of the mouth, the lines 40 may extend in other directions, the structure being that structure unitary or integral with the bag 10' opens the bag to receive a volume of air. In another embodiment, resilient bowed ribs 40' are integral with the bag 10' and extend in the direction of the lines or areas 40. Ribs 40' are incorporated into or with the panels 42 an 44 to bow the panels outwardly. When a force holding the unexpanded bag 10' flat is moved from the bag such as, for example, by removing a folded bag from a container or envelope and unfolding the bag.

From the foregoing description, one skilled in the art can easily ascertain the essential characteristics of this invention, and without departing from the spirit and scope thereof, can make various changes and modification of the invention to adapt it to various usages and conditions.

What is claimed is:

1. An inflatable pillow for supporting an object in abutment therewith comprising:

a plastic bag having side walls, a closed bottom, a mouth sealable by a rib-in-slot airtight fastener disposed adjacent to the mouth on the side walls;

means for holding the side walls of the bag apart when the mouth of the bag is opened to introduce a quantity of air from air surrounding the bag into the bag; the holding means comprising at least one prestressed area in the side walls of the bag, the prestressed area having a bias urging the walls of the bag apart and the rib-in-slot fastener open; the rib-in-slot fastener being thereafter sealable after closing the mouth of the bag to trap the quantity of air within the bag, wherein the bag becomes a cushion useable as a pillow.

2. An inflatable pillow comprising:

a plastic bag having a closed bottom, a mouth for being held closed and sealed by a rib-in-slot airtight fastener, and side walls; and a regulator strut hinged within the bag to move from a first position in which the regulator strut is substantially coextensive with the side walls and a second position in which the regulator strut extends transverse of the side walls to hold the side walls spaced from one another so that the bag fills with air surrounding the bag, the regulator strut being held temporarily in the second position by a collapsible support; whereby upon closing the rib-in-slot airtight fastener, a portion of the surrounding air is trapped within the bag and the collapsible support allows the regulator strut to return to the first position.

3. An inflatable pillow according to claim 2, wherein the regulator strut is hinged to one of the side walls and wherein the support is hinged to the regulator strut.

4. An inflatable pillow according to claim 3, wherein the support is configured as a support strut which extends from the regulator strut to the bottom of the bag.

5. An inflatable pillow according to claim 4, further including an attachment tab which is fixed to one wall of the bag, the attachment tab having the regulator strut pivoted thereto.

6. An inflatable pillow according to claim 5, wherein the regulator strut, support strut and attachment tab are each configured as panels.

* * * * *